US008464394B2

(12) United States Patent
Salice

(10) Patent No.: US 8,464,394 B2
(45) Date of Patent: Jun. 18, 2013

(54) DECELERATION DEVICE FOR A HINGE AND A HINGE HAVING THE DECELERATION DEVICE

(75) Inventor: Luciano Salice, Carimate (IT)

(73) Assignee: Arturo Salice S.p.A., Novedrate (IT)

( * ) Notice: Subject to any disclaimer, the term of this patent is extended or adjusted under 35 U.S.C. 154(b) by 340 days.

(21) Appl. No.: 12/863,588

(22) PCT Filed: Feb. 7, 2009

(86) PCT No.: PCT/EP2009/000868

§ 371 (c)(1),
(2), (4) Date: Jul. 19, 2010

(87) PCT Pub. No.: WO2009/115171

PCT Pub. Date: Sep. 24, 2009

(65) Prior Publication Data

US 2010/0293752 A1 Nov. 25, 2010
US 2012/0030906 A9 Feb. 9, 2012

(30) Foreign Application Priority Data

Mar. 19, 2008 (IT) ..... MI2008A0465

(51) Int. Cl.
*E05D 11/08* (2006.01)

(52) U.S. Cl.
USPC ..... 16/337; 16/54; 16/286

(58) Field of Classification Search
USPC ..... 16/286–288, 50, 54, 56, 82, 294, 16/DIG. 21, 319, 327, 337; 188/268, 276, 188/290, 291, 296, 322.5
See application file for complete search history.

(56) References Cited

U.S. PATENT DOCUMENTS

| | | | | |
|---|---|---|---|---|
| 4,449,269 | A * | 5/1984 | Sundermeier et al. | 16/50 |
| 4,576,252 | A * | 3/1986 | Omata | 185/39 |
| 4,691,811 | A * | 9/1987 | Arakawa et al. | 188/290 |
| 7,003,851 | B2 * | 2/2006 | Salice | 16/285 |
| 7,328,484 | B2 * | 2/2008 | Salice | 16/354 |
| 7,757,348 | B2 * | 7/2010 | Salice | 16/286 |
| 2004/0103499 | A1 | 6/2004 | Egger | |
| 2006/0026792 | A1 * | 2/2006 | Brustle et al. | 16/54 |

(Continued)

FOREIGN PATENT DOCUMENTS

| | | |
|---|---|---|
| EP | 1344885 A2 | 9/2003 |
| EP | 1809843 A1 | 7/2007 |
| WO | 2006/051074 | 5/2006 |
| WO | 20090059662 | 5/2009 |

OTHER PUBLICATIONS

International Search Report w/Written Opinion for International Application No. PCT/EP2009/000868.

*Primary Examiner* — Chuck Y. Mah
(74) *Attorney, Agent, or Firm* — Fitch, Even, Tabin & Flannery LLP

(57) ABSTRACT

A device for decelerating the rotation of a hinge in particular for furniture, comprises a container accommodating at least one rotating friction element adapted to slide on a friction surface, a slider moveable along a translational direction during the rotation of the hinge, and kinematic means for transforming the translation of the slider into a rotation of the at least one friction element, the slider having first means for receiving its movement during the opening of the hinge, distinct and separated from second means for receiving its movement during the closure of the hinge, the kinematic means comprise a drawing element integrally joined to the slider and permanently confined inside the profile of a cam provided for on the friction element.

21 Claims, 6 Drawing Sheets

U.S. PATENT DOCUMENTS

2007/0136990 A1 6/2007 Salice
2007/0158152 A1* 7/2007 Cultraro ..... 188/290
2008/0169696 A1* 7/2008 Kojima et al. ..... 297/378.1
2008/0276426 A1* 11/2008 Salice ..... 16/333
2009/0049645 A1* 2/2009 Salice ..... 16/250
2010/0205775 A1* 8/2010 Salice ..... 16/337

* cited by examiner

DECELERATION DEVICE FOR A HINGE AND A HINGE HAVING THE DECELERATION DEVICE

CROSS REFERENCE TO RELATED APPLICATIONS

This application is a U.S. national phase application of International Application No. PCT/EP2009/000868, filed Feb. 7, 2009, which claims benefit from Italian Application No. MI2008A000465, filed Mar. 19, 2008, both of which are hereby incorporated herein by reference in their entirety.

FIELD

The present invention refers to a device for decelerating the rotation of a hinge in particular for furniture and to the hinge having said deceleration device.

BACKGROUND

Available in the market over the years have been hinges for furniture comprising an arm adapted to be fixed to a fixed element of the furniture, and a box-shaped element adapted to be fixed to a door of the furniture, a first and a second equaliser connecting the box-shaped body and the arm operatively to each other and they define an articulated quadrilateral therewith.

Such hinges usually have springs of various types for creating a closure and/or opening restoring force of the doors on which they are applied. In such hinges, the presence of devices for decelerating the movement of the doors caused by the elastic reaction of such springs is desirable. First and foremost, such deceleration devices have the object of preventing noises due to violent impacts against the body of the furniture when closing the door.

Known are deceleration devices based on the use of viscous media interposed between the parts in mutual movement.

Such devices reveal a serious drawback linked to the fact that the efficiency of the deceleration device strongly depends on the ambient temperature in which the viscous medium operates being that its viscosity clearly depends on such temperature.

For example, use of a medium with a high viscosity might be counterproductive if the ambient temperature drops excessively given that it might cause the hinge to block, while the use of a medium with a low viscosity might be inefficient if the ambient temperature rises excessively (for example if a light beam produced by an artificial light present in a room is directed the hinge in question).

Provided for have been deceleration systems having a combined effect of the mechanical/viscous type for decelerating the rotation of the hinge.

In particular, reference is made to deceleration systems in which a plastic container filled with a viscous fluid accommodates a friction disc actuatable in rotation against a friction surface. In particular, a slider translatable due to the rotation of the hinge supports a drawing element adapted to transform the translation of the slider into a rotation of the friction disc.

Such deceleration systems reveal the drawback of having a limited structural efficiency and resistance alongside a short duration linked to the high stress and wear the parts they are made up of are subjected to.

In particular, in some of such systems, the slider is required to simultaneously have characteristics in conflict with each other, i.e. sufficient rigidity to rotate the friction disk during the hinge closure rotation and sufficient elasticity in a manner such to be capable of bending during the hinge opening rotation so as not to move the friction disc. The repeated mechanical stress on the slider may lead to its breakage, especially taking into account the fact that when the hinge remains idle for a long period of time, the static molecular adherence of the viscous fluid is greater and thus increases the force required for the subsequent rotational actuation of the hinge and hence also the mechanical stress the slider is bound to bear.

Furthermore, it should be added that in such deceleration systems the forces to which the slider is subjected to are often concentrated at only one of its zones which inevitably weakens gradually.

Another drawback observed on a traditional deceleration system applied outside the box-shaped body of the hinge is linked to the necessity of having an ideal rigidity and mechanical resistance so as to maintain an intact configuration even in case of possible mechanical stresses required during its installation, such as for example stresses occurring if the hole of the door of the furniture is not accurately dimensioned to accommodate the box of the hinge it is required to receive. In such case, a deformation of the container of the deceleration system may lead to deteriorating the performance of the device, greater wear of the parts and hence a short duration as well as extra maintenance costs.

SUMMARY

Therefore, the technical task proposed by the present invention is that of providing a deceleration device for a furniture hinge capable of eliminating the drawbacks revealed by the prior art.

In the scope of this technical task, an object of the invention is that of providing a deceleration device for a furniture hinge capable of maintaining the ideal efficiency upon the variation of the ambient temperature conditions under which it operates.

Another object of the invention is that of providing a deceleration device for a furniture hinge which is mechanically extremely resistant, compact, long-lasting and inexpensive.

The technical task, as well as these and other objects, according to the present invention are attained by providing a deceleration device for a furniture hinge according to claim 1.

Furthermore, other characteristics according to the present invention are defined in the subsequent claims.

BRIEF DESCRIPTION OF THE DRAWINGS

Further characteristics and advantages of the invention shall be clearer from the description of a preferred but not exclusive embodiment of the deceleration device for a furniture hinge according to the finding, illustrated for indicative and non-limiting purposes in the attached drawings, wherein.

DETAILED DESCRIPTION

Figure 1:
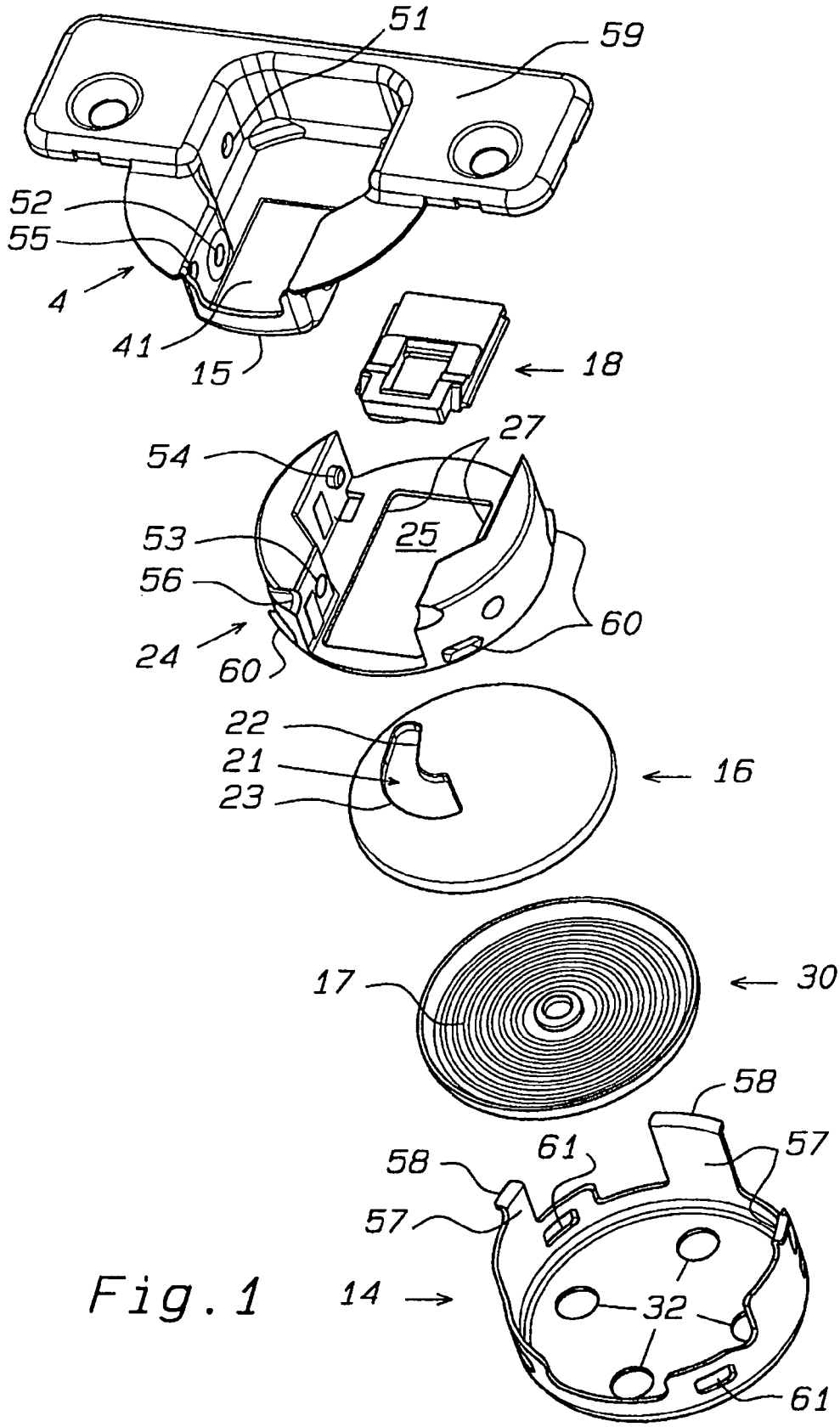
FIG. 1 shows an exploded perspective view of the deceleration device and of the box-shaped body of the furniture hinge according to a preferred embodiment of the invention.
Figure 2:
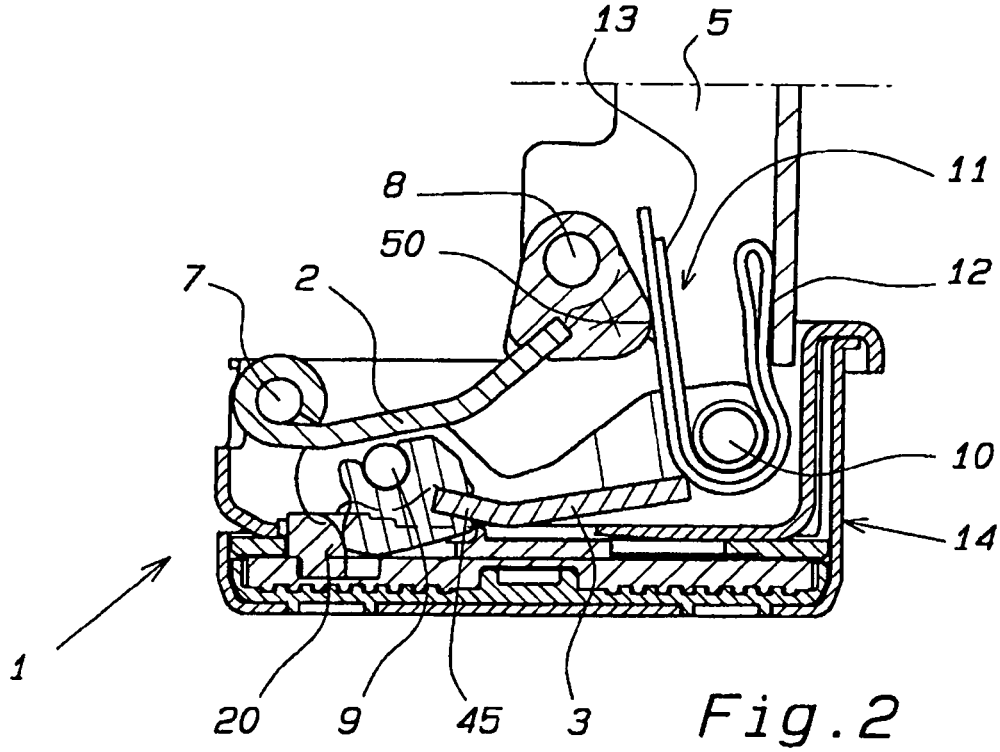
FIG. 2 shows a side elevation view of the deceleration device of FIG. 1 diametrically sectioned at the closure position of the hinge.
Figure 3:
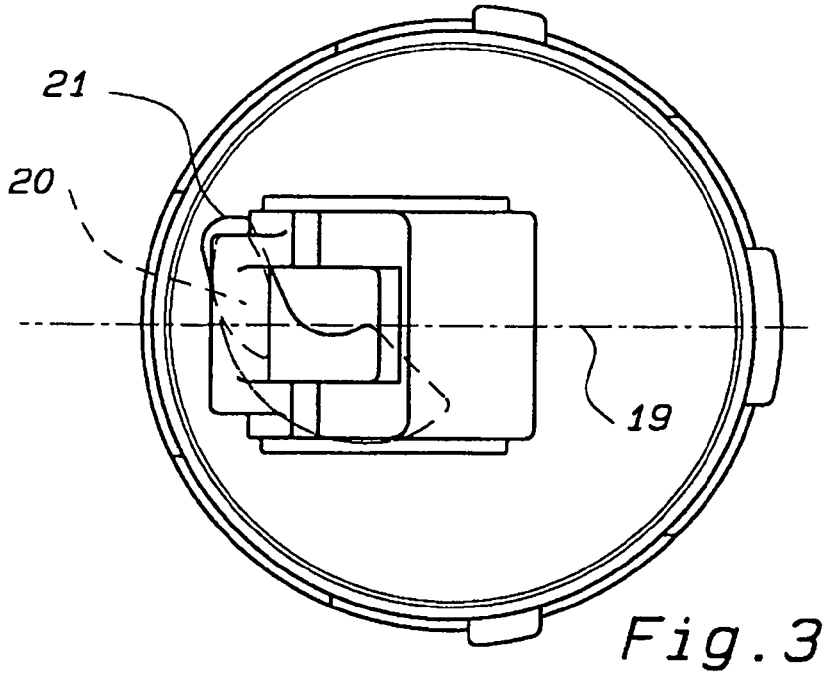
FIG. 3 is a plan view of the deceleration device of FIG. 1 in the hinge closure position.
Figure 4:
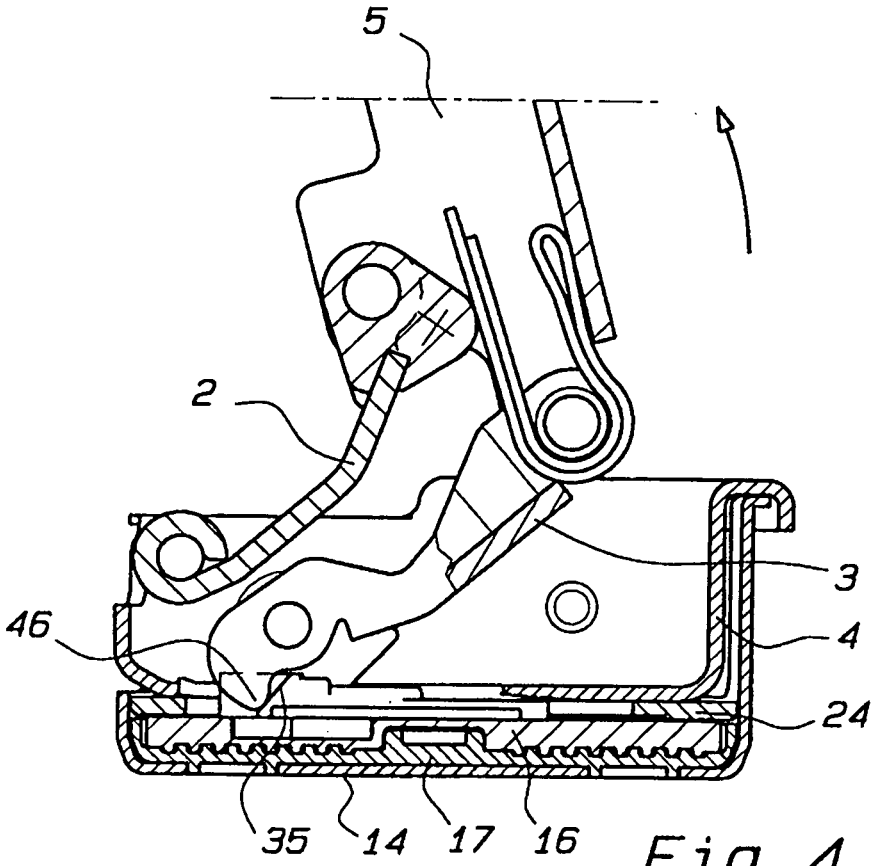
FIG. 4 shows a side elevation view of the deceleration device of FIG. 1 diametrically sectioned in the position it is found during a partial opening of the hinge.
Figure 5:
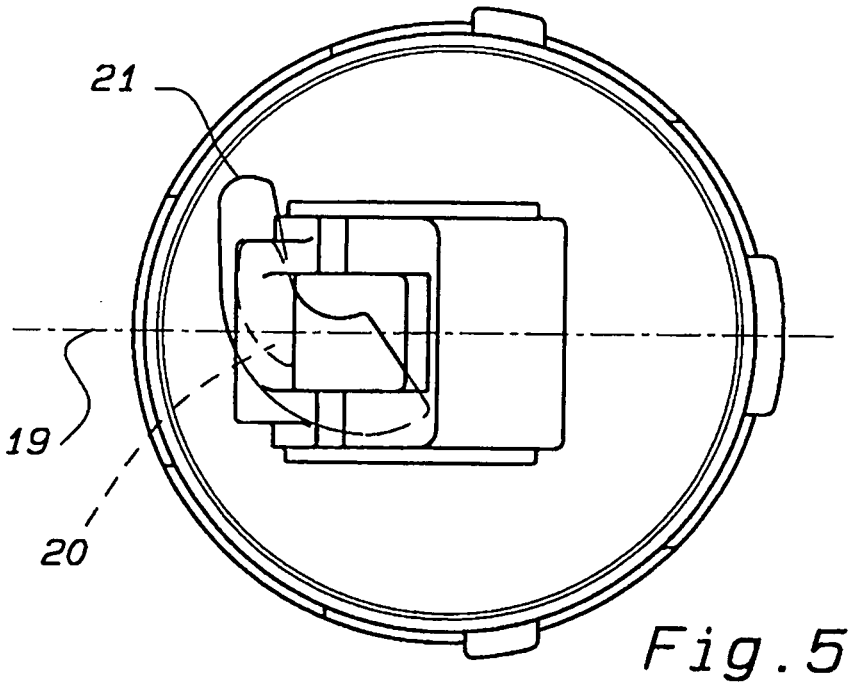
FIG. 5 is a plan view of the deceleration device of FIG. 1 in the partial opening position of the hinge corresponding to FIG. 4.
Figure 6:
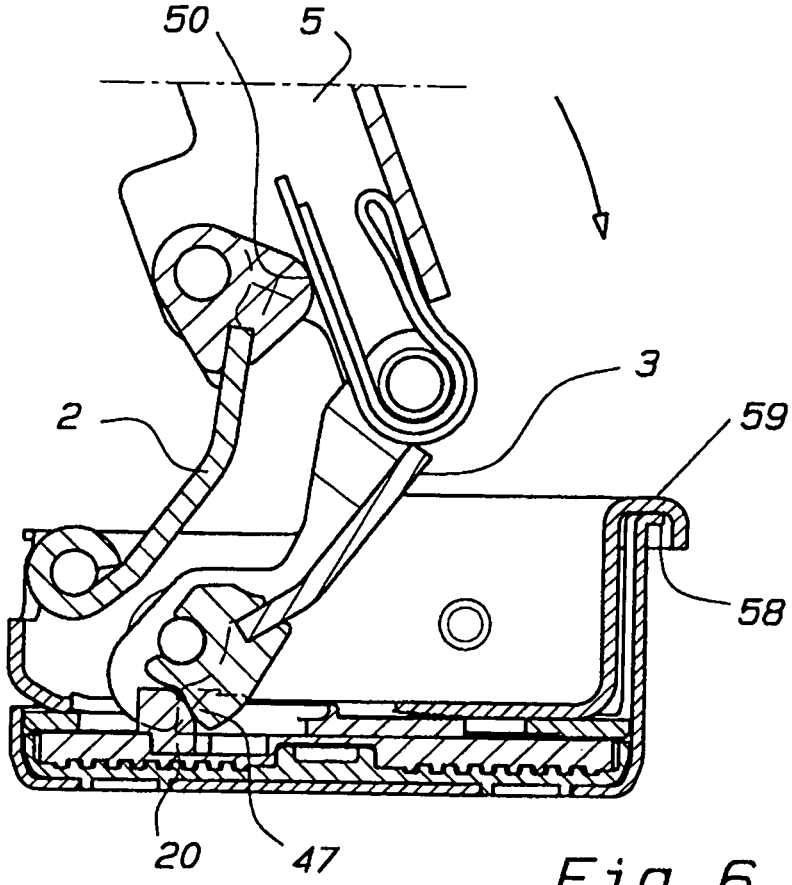
FIG. 6 shows a side elevation view, of the deceleration device of FIG. 1 diametrically sectioned in the position corresponding to the beginning of the hinge closure step.
Figure 7:
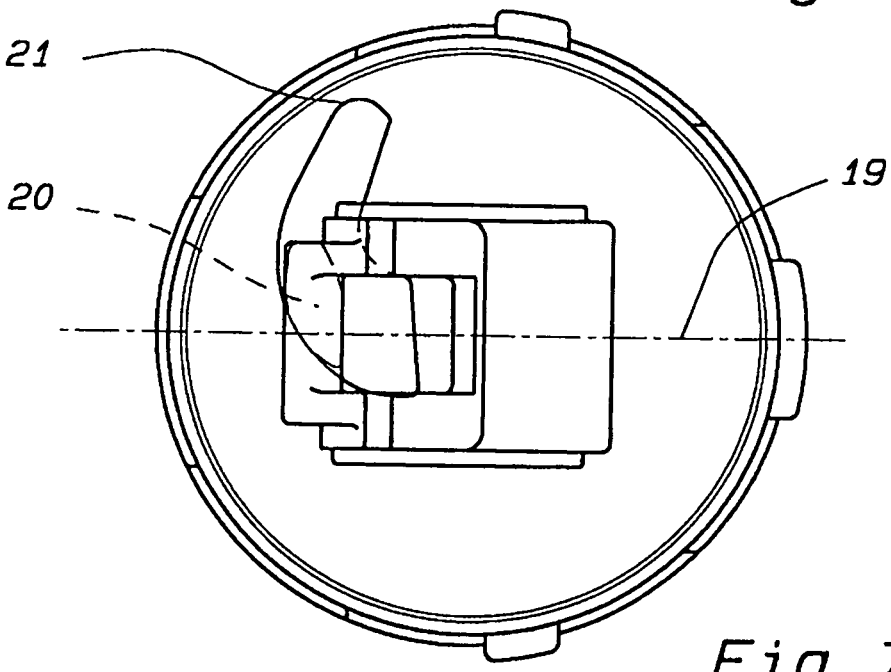
FIG. 7 is a plan view of the deceleration device of FIG. 1 in the position of the hinge corresponding to FIG. 6.
Figure 8:
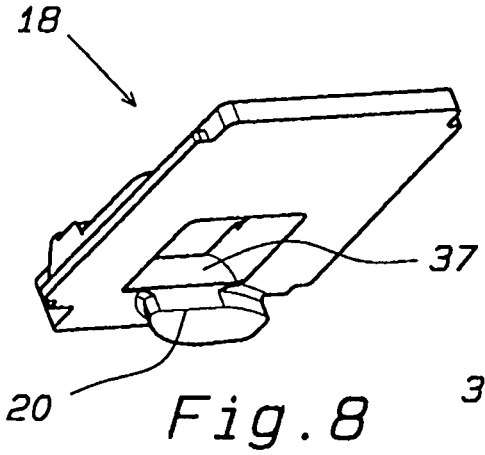
FIGS. 8 and 9 show a bottom and top perspective view of the slider of the acceleration device of FIG. 1.
Figure 9:
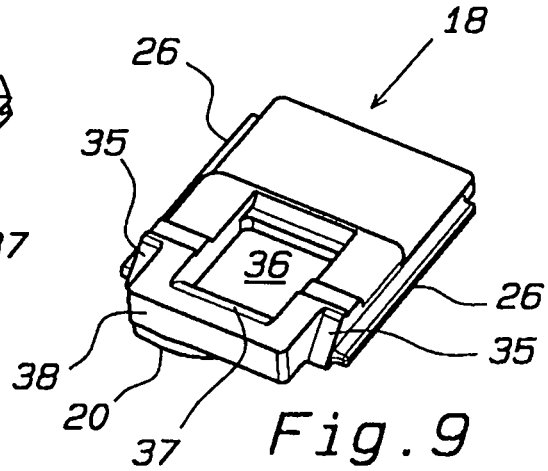
Figure 10:
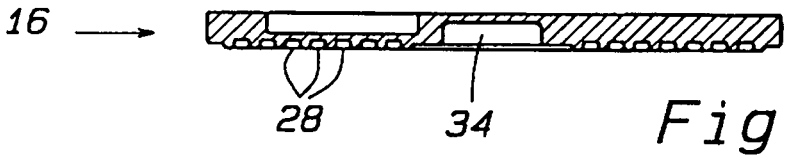
FIG. 10 shows a diametrically sectioned side elevation view of the friction disc of the deceleration device of FIG. 1.
Figure 11:
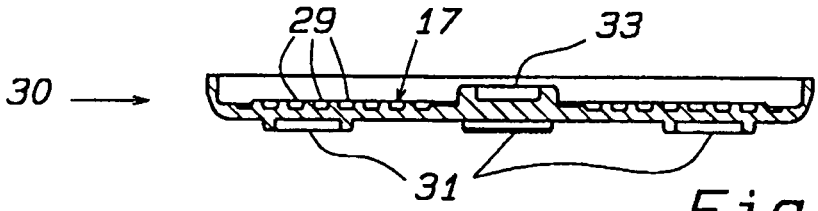
FIG. 11 shows a diametrically sectioned side elevation view of the disc borne fixed on the bottom of the container of the deceleration device of FIG. 1.
Figure 12:
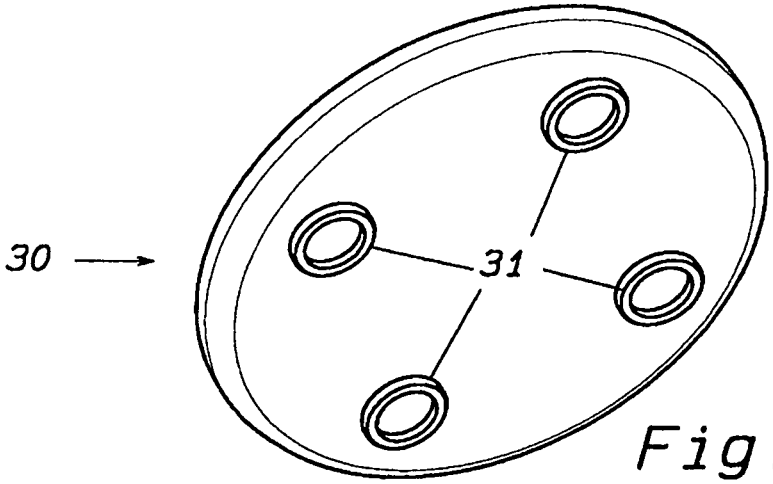
FIG. 12 is a perspective view of the disc of FIG. 11.
Figure 13:
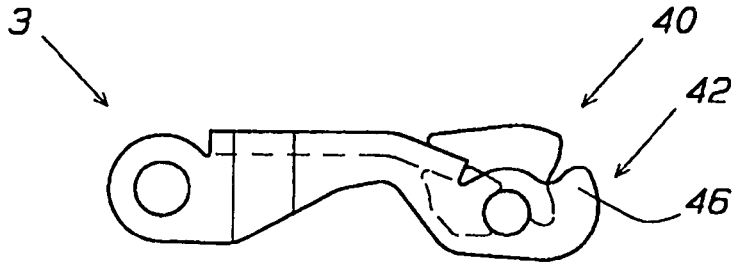
FIG. 13 is a side elevated view of one of the equalisers of the hinge of FIG. 2, indicated on which is a cam for the hinge closure actuation of the deceleration device of FIG. 1.
Figure 14:
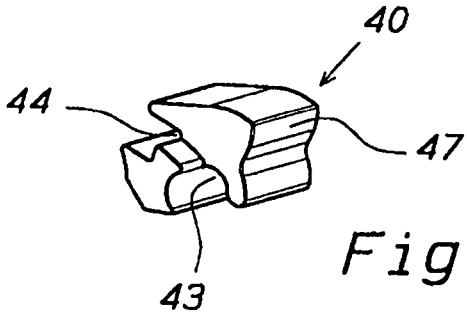
FIG. 14 is a perspective view of the cam indicated in the equaliser of FIG. 13.

Referring to the abovementioned figures, a deceleration device for a furniture hinge is shown indicated in its entirety with reference number 1.

The hinge onto which the deceleration device 1 is applied, is of the type comprising a first and a second equaliser 2, 3 which operatively connect a box-shaped body 4 and an arm 5.

The box-shaped body 4 is adapted to be fixed onto a furniture door while the arm 5 is adapted to be fixed onto a fixed element (not shown) of the furniture, for example a side of the furniture.

In particular, the first equaliser 2 is pivoted with a pivot 7 to the box-shaped body 4 and with a pivot 8 to the arm 5, while the second equaliser 3 is pivoted with a pivot 9 to the box-shaped body 4 and with a pivot 10 to the arm 5. The hinging pivots 7, 8, 9 and 10 have parallel axis. The structure made up of the box-shaped body 4 and the arm 5 operatively connected by the equalisers 2 and 3 through the pivots 7, 8, 9 and 10 forms an articulated quadrilateral.

Present around the hinging pivot 10 is a spring 11 having a first arm 12 associated to the arm 5 and a second arm 13 associated to the equaliser 2.

The spring 11, during the final closure phase of the door, allows creating a restoring force on the door for its spontaneous and accurate closure.

The deceleration device 1 comprises a container 14 to be fixed onto the external side of the bottom 15 of the box-shaped body 4.

The container 14, accommodates at least one and in the particular case only one friction element 16 rotating on a friction surface 17, a slider 18, preferably plate-shaped, moveable along a translation direction 19 during the rotation of the hinge, and kinematic means for transforming the translation of the slider 18 into a rotation of the of the friction element 16.

The kinematic means comprise a drawing element 20 integral with the slider 18 and permanently confined in the profile of a cam 21 provided for on the friction element 16.

Preferably, the cam 21 is made up of a blind-bottom cavity contained in the thickness of the friction element 16.

The drawing element 20 is selectively engageable with a first section 22 of the cam profile 21 for the rotational actuation of the friction element 16 during the opening of the hinge or with a second section 23 of the cam profile 21 for the rotational actuation of the friction element 16 during the final hinge closure phase.

The slider 18 has first means for receiving its movement during the opening of the hinge distinct and separated from second means for receiving its movement during the closure of the hinge.

According to a particularly advantageous aspect, the container 14 is made of metal or rigid material in any case, i.e. suitable to confer the required mechanical resistance, while the other parts of the deceleration device are preferably made of plastic.

Furthermore, the container 14 has a support or cover 24 which withholds the elements present therein.

In particular, the cover 24 has a window 25 along which the slider 18 is guided in a translatable manner.

The slider 18 is quadrangular-shaped and it is provided, on two opposite rectilinear sides, with rectilinear guide ribs 26 introduced beneath the bottom of the box-shaped body 4 and guided between the opposite rectilinear sides 27 of the window 25.

In the illustrated preferred embodiment, the container 14 is cylindrical, and the friction element 16 is in particular a first flat-shaped circular disc arranged coaxially with respect to the container 14 and having, on its side facing the bottom of the container 14, a first plurality of concentric indentations 28 which are engaged on the friction surface 17 in turn comprising a second plurality of concentric indentations 29 having a shape coupled with the first plurality of concentric indentations 28 and made on a second plate-shaped circular disc 30 arranged coaxially with respect to the container 14 to whose bottom it is associated in a fixed manner.

More precisely, the second disc 30 has—at its side facing the bottom of the container 14—bosses 31 accommodated in respective recesses 32 made on the inner side of the bottom of the container 14, and—on its side facing the friction element 16, alongside the indentations 29, also a central hub which is engaged in a central pipe piece 34 of the friction element 16 for centring thereof.

The cam 21 has a curvilinear development in the radial direction on the friction element 16 and in particular a width progressively increasing from the periphery towards the centre of the friction element 16.

The first means for receiving the movement of the slider 18 comprise ramps 35 obtained on the opposite lateral sides of the slider 18 while the second reception means comprise a bevelled edge 37 of a side of a quadrangular opening 36 of the slider 18.

The side of the opening 36 having the bevelled edge 37 is close and parallel to the front edge 38 of the slider 18. The drawing element 20 is extended in a single piece from the lower surface of sector of the slider 18 delimited between the side of the opening 36 having the bevelled edge 37 and the front edge 38 of the slider 18.

The slider 18 is accessible to the equaliser 3 through a window 41 of the bottom of the box-shaped body 4 overlapped at the window 25 of the cover 24.

The equaliser 3 has a U-shaped transverse section with a back and lateral sides, apically made on each of which is a first cam 42 for controlling the first means for receiving the movement of the slider 18, made in a single piece with the second equaliser 3. A second cam 40 for controlling second reception means 18 is made from an element different from the equaliser 3, on which it is mounted.

The first control cam 42 comprises lateral projections 46 at ends of the sides of the equaliser 3 each adapted to interfere with a corresponding ramp 35.

The element defining the second control cam 40 has a profile adapted to interfere with the bevelled edge 37, a cylindrical grooving 43 opened laterally adapted to accommodate the pin 9 and a seat 44 for coupling with the back 45 of the second equaliser 3.

Referring to FIGS. 1-14, the deceleration device 1 has means for quick coupling to the box-shaped body 4 of the hinge, in particular comprising a U-bolt (not shown) with parallel shanks adapted to engage into special holes 52 and 55 of the box-shaped body 4 and 53, 56 of the cover 24 (alternatively, the holes 53, 56 can be provided for on the container 14). The parallel shanks of the U-bolt advantageously form the pivots 7 and 9 for hinging the equalisers 2 and 3 against the box-shaped body 4. This allows mounting the deceleration device by simply adding a station to the pre-existing assembly line of the hinge which thus does not require modifications.

Abutment means are provided for between the complex formed by the container 14 and by its cover 24 on one side and the box-shaped body 4 of the hinge on the other, ending up mutually arranged at the proper position for the subsequent blocking by means of the U-bolt thereof.

The abutment means comprise at least one pin 54 on the cover 24 fittable into a corresponding hole 51 on the box-shaped body 4 of the hinge.

The container 14 comprises spacer means adapted to support it at a distance from the box-shaped body 4.

The spacer means include perimetral extensions 57 which project along the generators of the container 14 and they are engaged on the external side of the box-shaped body 4. In particular, each extension 57 has a corresponding flange 58 abutting against the bottom of a flange 59 facing the external of the box-shaped body 4.

The coupling of the cover 24 to the container 14 is on the contrary obtained by means of elastic snap-teeth 60 provided for on the lateral surface of one of the engagements into slots 61 provided for on the lateral surface of the other.

Figure 15:
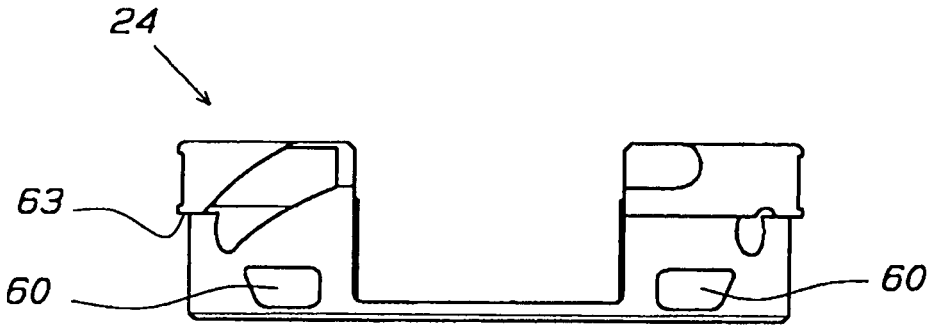
FIG. 15 is a side elevation view of a second preferred method of attaining, according to the present invention, the spacing between the container of the deceleration device and the box-shaped body of the hinge of FIG. 1.
Figure 16:
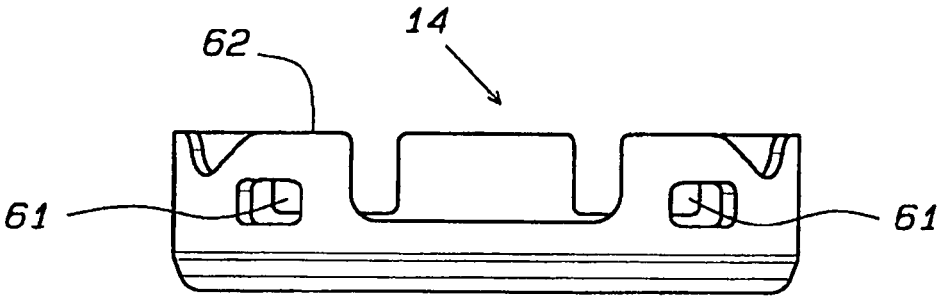
FIG. 16 is a side elevation view of the container of the deceleration device according to the second preferred method of attaining the present invention.

Now, referring to FIGS. 15 and 16, the spacer means adapted to support the container 14 at a distance from the box-shaped body 4 are made up of the cover 24 itself which is not fitted but supported above the top of the container 14 in such a manner to space it from the box-shaped body 4.

In particular, the apical perimetral edge 62 of the container 14 lies on a perimetral collar 63 of the cover 24.

The coupling of the cover 24 to the container 14 is further secured by elastic teeth 60 and by the slots 61.

The operation of the deceleration device 1 is briefly as follows.

During the closure rotation of the hinge (FIG. 6) the second control cam 40, rotating around the pin 9, ends up interfering and starts pressing against the bevelled edge 37 with its profile 47 causing the translation in the direction of the slider 18. In this direction of translation the drawing member 20 is initially detached from the edge 22 of the cam 21 and after ending in contact with the edge of the cam 21 it starts pushing it rotating the friction element 16. The drawing friction generated at the contact surfaces between the friction element 16 and the second disc 30 determines the desired deceleration at the final part of the closure of the hinge.

On the contrary, during the rotation towards the hinge opening direction (FIG. 4), by rotating around the pin 9, the projections 46 of the first control cam 42 press against the ramps 35 causing the translation in the opposite direction with respect to the slider 23. In this direction of translation, the drawing member 20 is initially detached from the edge 23 of the cam 21 and after ending in contact with the edge 22 of the cam 21 it starts pushing it rotating the friction element 16.

In a further embodiment of the deceleration device 1 it is possible to fill the container 14 with a viscous medium to attain the deceleration with a combined effect of the mechanical and viscous type.

In conclusion, the deceleration device of the present invention has a high efficiency regardless of whether it is based on a strictly mechanical effect or a combined effect of the mechanical and viscous type.

The drawing element is structurally extremely sturdy and the slider supporting it remains integral over a long period of time, in that the stresses due to its movement are distributed in different and distinct areas depending on the direction of rotation to close or open the hinge.

The metal or rigid material in any case making up the container prevents the deformation, during installation into the hole, of the furniture door and guarantees ideal performances, greater duration and lower maintenance costs.

It should also be observed that in a preferred embodiment of the hinge according to the invention it is possible to provide for a special control cam 50, on the first equaliser 2, for actuating the flexure spring 11. Present between the control cam 50 and the flexure spring 11 is a contact surface which, during the rotation of the hinge, moves both along the profile of the control cam 50 and along the profile of the flexure spring 11. The control cam 50 has an arched profile having a constant radius of curvature and a centre of curvature located at a distance from the pin 8 for hinging the first equaliser 2 to the arm 5.

With this special control cam 50, on one hand the hinge ensures that the actuation angle of the deceleration device is comprised in the operation angle of the flexure spring 11 again during closure in such a manner to prevent the occurrence of a stalemate wherein the flexure spring 11 does not yet have enough closing force, while the deceleration device is already operating, and ensures, on the other hand, that there are no jams sue to the amassing of the actions of the flexure spring 11 and the deceleration device during opening.

The deceleration device thus conceived is susceptible to various modifications and variants, all falling within the scope of the inventive concept; furthermore, all details can be replaced by technically equivalent elements.

In practice, the material used, as well as the dimensions, may vary depending on the requirements and the state of the art.

The invention claimed is:

1. Device for decelerating rotation of a hinge in particular for furniture, of the type comprising a container accommodating at least one rotating friction element and a friction surface, the at least one rotating friction element adapted to slide on said friction surface, a slider moveable along a translational direction during the rotation of said hinge, and kinematic means for transforming translation of said slider into a rotation of said at least one friction element, said kinematic means comprise a drawing element integrally joined to said slider and permanently confined inside the profile of a cam provided for on said friction element, said cam has a curvilinear development in radial direction on said friction element, and a width progressively increasing from a periphery towards a center of said friction element, said drawing element being selectively engageable with a first section of said profile of said cam for rotating said friction element during opening rotation of said hinge or with a second section of said profile of said cam for rotating said friction element during a final phase of closure rotation of said hinge.

2. Device for decelerating the rotation of a hinge for furniture according to claim 1, wherein said container is made of metal or rigid material.

3. Device for decelerating the rotation of a hinge for furniture according to claim 1, wherein said container has a support or cover having a window along which said slider is guided in a translatable manner.

4. Device for decelerating the rotation of a hinge for furniture according to claim 3, further comprising means for snap-coupling between said container and said cover.

5. Device for decelerating the rotation of a hinge for furniture according to claim 1, wherein said friction element is a first plate-shaped circular disc.

6. Device for decelerating the rotation of a hinge for furniture according to claim 5, wherein said first plate-shaped circular disc has, at its side facing a bottom of said container, a first plurality of concentric indentations which engage on said friction surface, in turn comprising a second plurality of concentric indentations having a shape coupled to said first plurality of concentric indentations, said second plurality of concentric indentations being on a second plate-shaped circular disc that includes the friction surface and is permanently associated to said bottom of said container.

7. Device for decelerating the rotation of a hinge for furniture according to claim 5, wherein said cam is made up of a blind-bottom cavity contained in a thickness of said first plate-shaped circular disc.

8. Device for decelerating the rotation of a hinge for furniture according to claim 1, wherein said container is filled with a viscous medium to attain said deceleration with a combined effect of mechanical and viscous type.

9. Furniture hinge of a type comprising a first and second equalizer each pivotally connected to a box-shaped body adapted to be fixed onto a door of said furniture and to an arm adapted to be fixed onto a fixed element of said furniture, further comprising the device according to claim 1, fixed on an external side of a bottom of said box-shaped body.

10. Furniture hinge according to claim 9, further comprising spacer means adapted to support said container at a distance from said box-shaped body.

11. Furniture hinge according to claim 10, wherein said spacer means comprise perimetral extensions which are projected along said container and engaged on said external side of said box-shaped body.

12. Furniture hinge according to claim 9, wherein said container includes a cover having a window along which said slider is guided in a translatable manner, said cover being supported above a top of said container to space said cover from said box-shaped body.

13. Furniture hinge according to claim 9, further comprising means for quick coupling of said device to said box-shaped body.

14. Furniture hinge according to claim 13, wherein said quick coupling means comprise a U-bolt having parallel shanks engaging in special holes of said box-shaped body and said container or said cover.

15. Furniture hinge according to claim 14, wherein said shanks form pins for engagement of said equalizers to said box-shaped body.

16. Furniture hinge according to according to claim 9, wherein the bottom of said box-shaped body has a window through which one of said equalizers accesses said slider, further comprising a first cam for controlling first reception means for receiving said slider, said first cam being made in a single piece with said one of the equalizers, and a second control cam mounted on said one of the equalizers for controlling second reception means for receiving said slider.

17. Furniture hinge according to claim 9, further comprising a control cam present on said first equalizer for actuating a flexure spring for a return of said door, a contact surface between said control cam for actuating said flexure spring and said flexure spring which, during rotation of said hinge, moves both along profile of said cam for controlling said flexure spring and along a profile of said flexure spring, said control cam having an arched profile with a constant radius of curvature and center of curvature positioned at a distance from a pin for hinging said first equalizer to said arm.

18. Device for decelerating the rotation of a hinge for furniture according to claim 1, further comprising an equalizer including first and second reception means, said first reception means cooperating with a first control cam for receiving said slider during opening rotation of said hinge, said first reception means being distinct and separated from said second reception means cooperating with a second control cam for receiving said slider during closure rotation of said hinge.

19. Device for decelerating the rotation of a hinge for furniture according to claim 18, wherein said first reception means comprise ramps on opposite lateral sides of said slider.

20. Device for decelerating the rotation of a hinge for furniture according to claim 19, wherein said second reception means comprise a bevelled edge of a side of a quadrangular opening of said slider.

21. Device for decelerating the rotation of a hinge for furniture according claim 18, wherein said first control cam comprises lateral projections at ends of sides of said equalizer of said hinge and said second control cam is made from an element different from said equalizer, said second control cam being mounted on said equalizer.

* * * * *

UNITED STATES PATENT AND TRADEMARK OFFICE

CERTIFICATE OF CORRECTION

PATENT NO. : 8,464,394 B2
APPLICATION NO. : 12/863588
DATED : June 18, 2013
INVENTOR(S) : Arturo Salice It is certified that error appears in the above-identified patent and that said Letters Patent is hereby corrected as shown below:

In the Claims:

Claim 16, Column 8, line 11, after “according to” delete “according to”

Claim 21, Column 8, line 45, after “according” insert -- to --

Signed and Sealed this
Twelfth Day of August, 2014

Michelle K. Lee

Michelle K. Lee
*Deputy Director of the United States Patent and Trademark Office*